US010340619B2

(12) United States Patent
Tsukiyoshi et al.

(10) Patent No.: US 10,340,619 B2
(45) Date of Patent: Jul. 2, 2019

(54) TERMINAL FITTING

(71) Applicant: Sumitomo Wiring Systems, Ltd., Yokkaichi, Mie (JP)

(72) Inventors: Keiichi Tsukiyoshi, Mie (JP); Kazuo Nakai, Mie (JP); Takahiko Saitou, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/945,063

(22) Filed: Apr. 4, 2018

(65) Prior Publication Data

US 2018/0294587 A1 Oct. 11, 2018

(30) Foreign Application Priority Data

Apr. 10, 2017 (JP) ..... 2017-077341

(51) Int. Cl.

| | |
|---|---|
| ***H01R 13/11*** | (2006.01) |
| ***H01R 13/115*** | (2006.01) |
| ***H01R 4/48*** | (2006.01) |
| ***H01R 13/422*** | (2006.01) |
| ***H01R 13/187*** | (2006.01) |

(52) U.S. Cl.

CPC ..... *H01R 13/113* (2013.01); *H01R 4/48* (2013.01); *H01R 13/114* (2013.01); *H01R 13/115* (2013.01); *H01R 13/187* (2013.01); *H01R 13/422* (2013.01)

(58) Field of Classification Search

CPC ..... H01R 9/0518; H01R 24/38; H01R 24/40; H01R 13/622; H01R 2103/00; H01R 13/187; H01R 13/50; H01R 13/10–13/193

USPC ..... 439/852, 839, 843, 850, 851, 856

See application file for complete search history.

(56) References Cited

U.S. PATENT DOCUMENTS

| | | | | |
|---|---|---|---|---|
| 4,778,231 | A * | 10/1988 | Seidler | H01R 13/193 439/295 |
| 4,838,816 | A * | 6/1989 | Matsusaka | H01R 13/193 439/861 |
| 7,419,411 | B2 * | 9/2008 | Kaneko | H01R 13/113 439/851 |
| 7,785,160 | B2 * | 8/2010 | Shimizu | H01R 43/16 439/595 |
| 7,988,505 | B2 * | 8/2011 | Hotea | H01R 13/187 439/852 |

(Continued)

FOREIGN PATENT DOCUMENTS

| | | |
|---|---|---|
| JP | 3473536 | 8/2003 |

*Primary Examiner* — Tulsidas C Patel
*Assistant Examiner* — Travis S Chambers
(74) *Attorney, Agent, or Firm* — Gerald E. Hespos; Michael J. Porco; Matthew T. Hespos

(57) ABSTRACT

A terminal fitting (10) includes a body (11) in the form of a rectangular tube, a tab (41) of a mating terminal (40) being inserted into the body (11) from the front. A resilient contact piece (22) is accommodated in the body (11). The tab (41) is sandwiched resiliently in a plate thickness direction thereof between the resilient contact piece (22) and a receiving plate (15) of the body (11). Holding portions (30) are formed integrally to the resilient contact piece (22) and capable of holding the tab (41) with a relative displacement of the tab (41) in a width direction with respect to the resilient contact piece (22) restricted by coming into contact with side edges (41S) of the tab (41).

7 Claims, 10 Drawing Sheets

(56) References Cited

U.S. PATENT DOCUMENTS 9,509,077 B2 * 11/2016 Iihoshi ..... H01R 13/4223

* cited by examiner

TERMINAL FITTING

BACKGROUND

Field of the Invention

The invention relates to a terminal fitting.

Description of the Related Art

Japanese Patent No. 3473536 discloses a terminal fitting with a box-shaped body and a resilient contact piece in the body. A tab inserted into the body is sandwiched resiliently between the ceiling of the body and the resilient contact piece. This terminal fitting is formed with a filling portion for filling clearances between inner side surfaces of the body and side edges of the tab to prevent fretting wear between the tab and the resilient contact piece. Thus, lateral vibration of the tab inside the body can be prevented. However, the resilient contact piece is displaceable with respect to the body in the width direction even if displacement of the tab with respect to the body is restricted. Thus, the resilient contact piece and the tab may be displaced from each other.

The invention was completed based on the above situation and aims to prevent fretting wear between a tab and a resilient contact piece.

SUMMARY

The invention is directed to a terminal fitting with a rectangular tubular body that can receive a tab of a mating terminal inserted into the body from the front. A resilient contact piece is in the body, and the tab can be sandwiched resiliently in a plate thickness direction between the resilient contact piece and a receiving plate of the body. A holding portion is formed integrally with the resilient contact piece and can contact a side edge of the tab to restrict displacement of the tab in a width direction with respect to the resilient contact piece. Thus, fretting wear due to relative displacements in the width direction does not occur between the resilient contact piece and the tab.

The holding portion may be resiliently displaceable in the width direction with respect to the resilient contact piece. According to this configuration, the holding portion slides in contact with the side edge of the tab while being resiliently deformed in the process of inserting the tab into the body. Thus, insertion resistance due to friction between the tab and the holding portion is reduced.

The resilient contact piece may have a base end connected to the body, a flat surface extending from the base end along an inserting direction of the tab, a curved surface connected to an extending end of the flat surface and a contact point formed on the curved surface. The contact point is capable of contacting the properly inserted tab. The holding portion rises substantially at a right angle from a side edge part of the flat surface portion. The holding portion is formed by being bent with respect to the resilient contact piece. Bending is performed at the side part of the flat surface. Therefore, processing is easier as compared to the case where the holding portion is bent at the curved surface portion.

The holding portion may include a rising portion connected to the flat surface and a contact portion extending from the rising portion toward the contact point. The contact portion is capable of contacting the tab. The contact portion of the holding portion is configured to contact the tab and is located near the contact point. Thus, the tab can be held near the contact point. Accordingly, relative displacements between the resilient contact piece and the tab at the contact point can be suppressed.

The terminal fitting may further include an excessive deflection restricting portion formed on a side plate of the body. The excessive deflection restricting portion is capable of restricting deformation of the resilient contact piece beyond a resilient limit by having an outer surface of the holding portion brought into contact therewith. Accordingly, plastic deformation of the resilient contact piece in the width direction can be prevented.

The terminal fitting may further include a deflection suppressing portion formed on a side plate of the body. The deflection suppressing portion is capable of suppressing deformation of the resilient contact piece in the width direction by having a side edge of the tab resiliently brought into contact therewith. According to this configuration, excessive deformation of the resilient contact piece in the width direction can be prevented.

The terminal fitting may further have a deflection suppressing portion formed on a side plate of the body. The deflection suppressing portion suppresses deformation by resiliently contacting a side edge of the resilient contact piece. The excessive deflection restricting portion restricts deformation of the deflection suppressing portion beyond a resilient limit by contacting an outer surface of the deflection suppressing portion. This configuration suppresses plastic deformation of the deflection suppressing portion in the width direction. Further, the excessive deflection restricting portion also has a function of restricting excessive deflection of the deflection suppressing portion, thereby simplifying the shape of the side plate.

DETAILED DESCRIPTION

Figure 1:
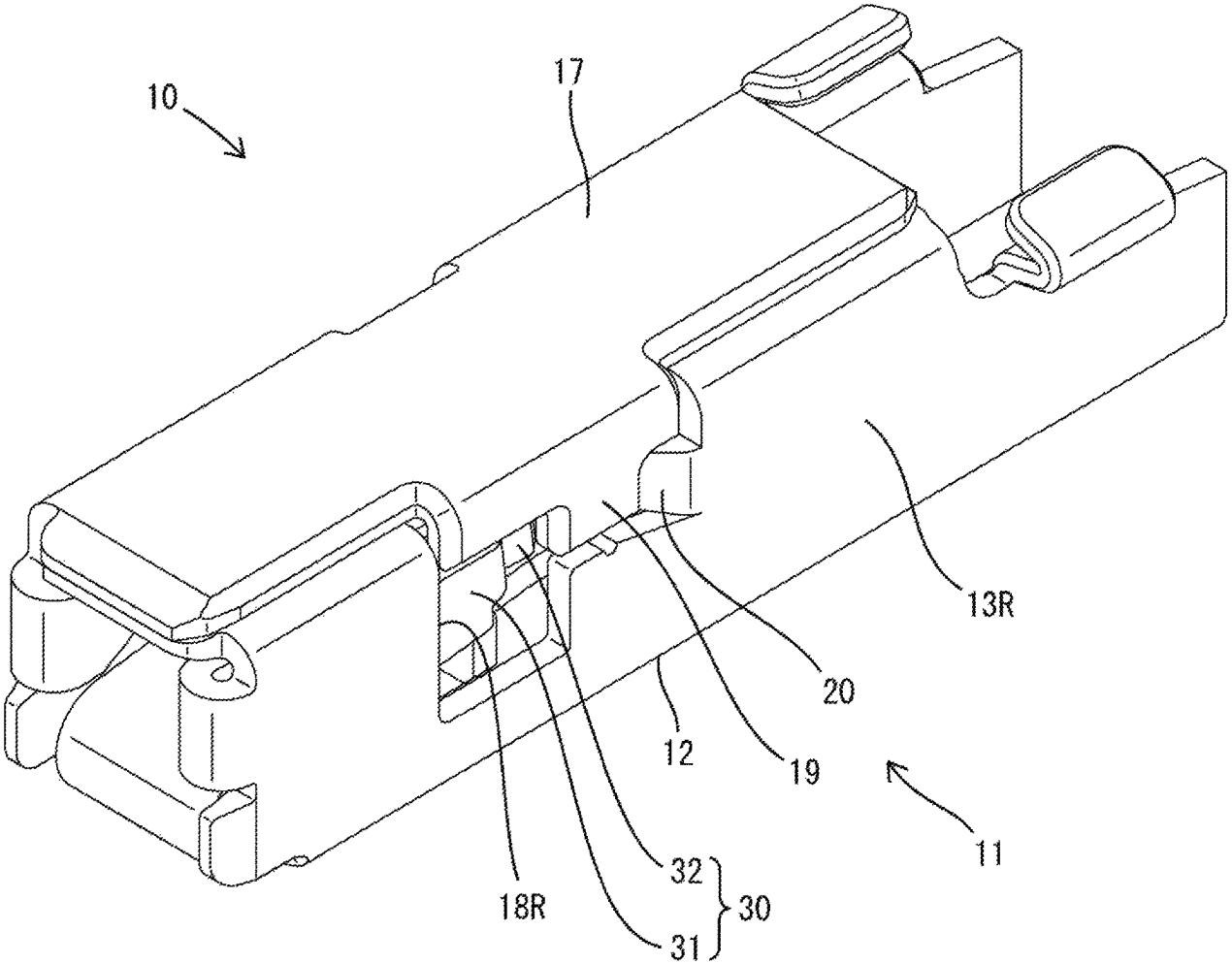
FIG. 1 is a perspective view of a terminal fitting of an embodiment without a rear part.
Figure 2:
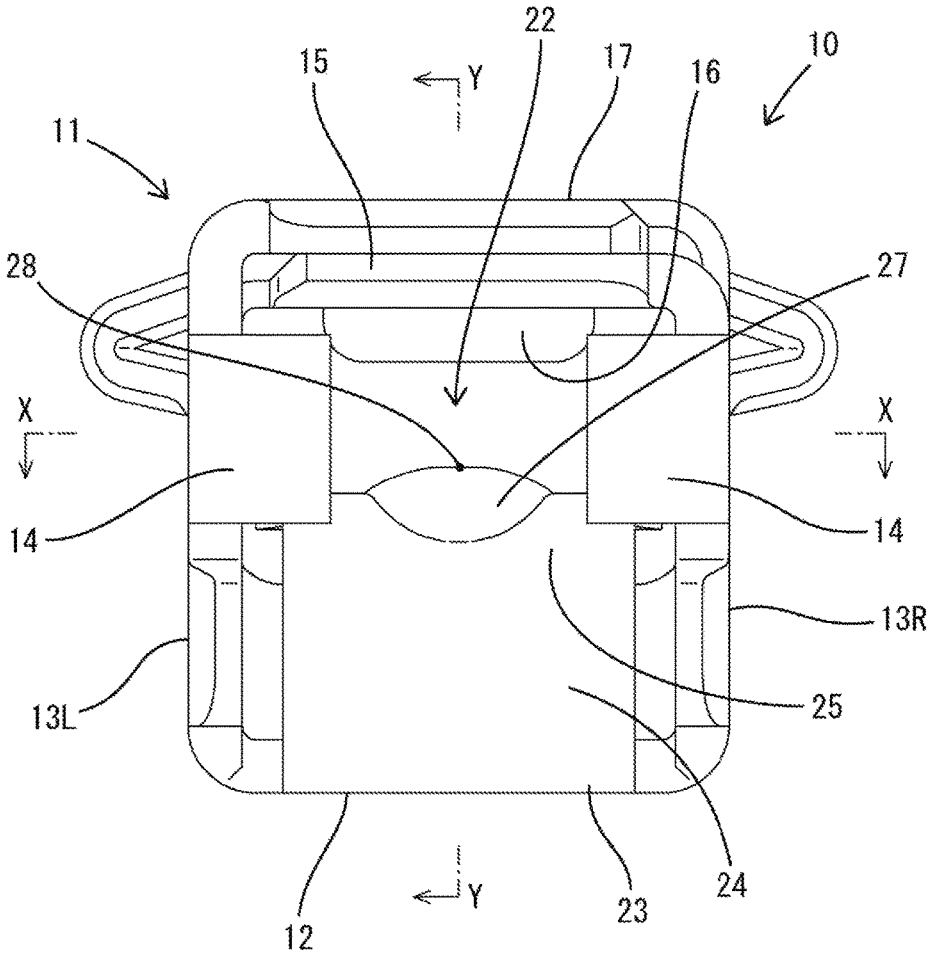
FIG. 2 a front view of the terminal fitting.
Figure 3:
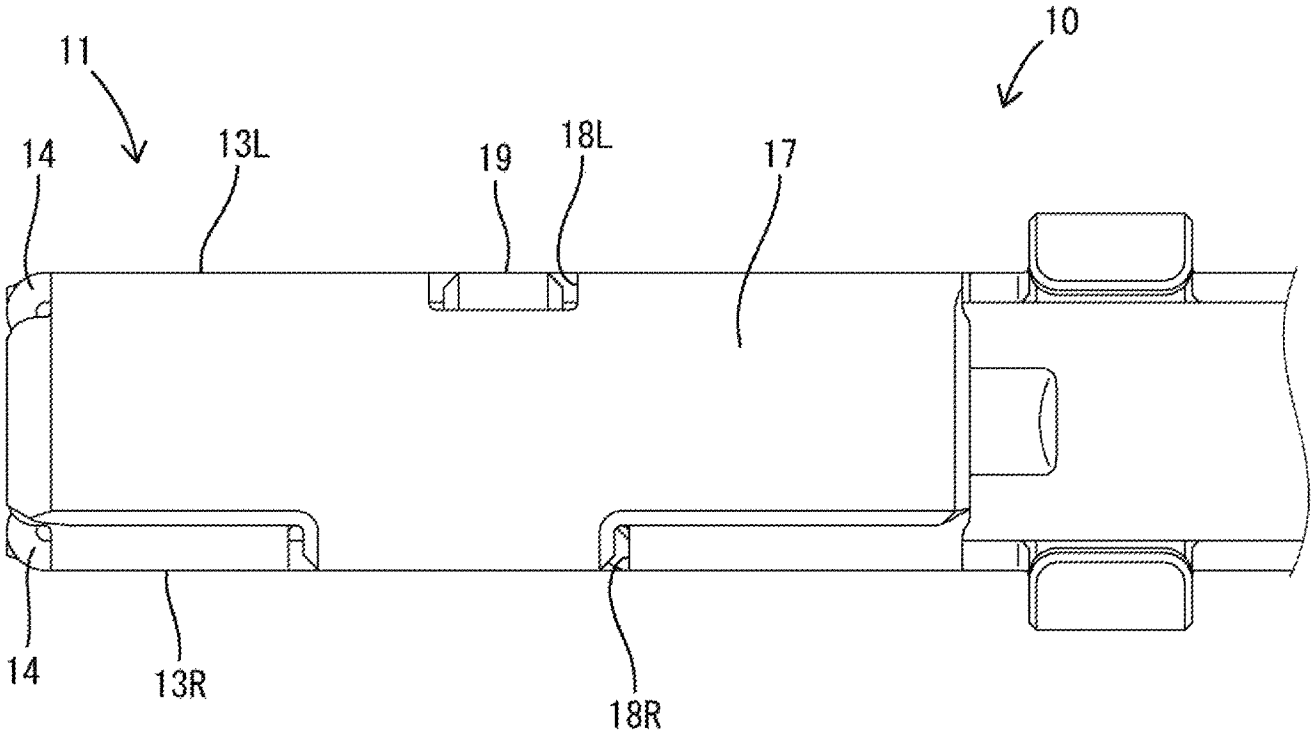
FIG. 3 is a plan view of the terminal fitting.
Figure 4:
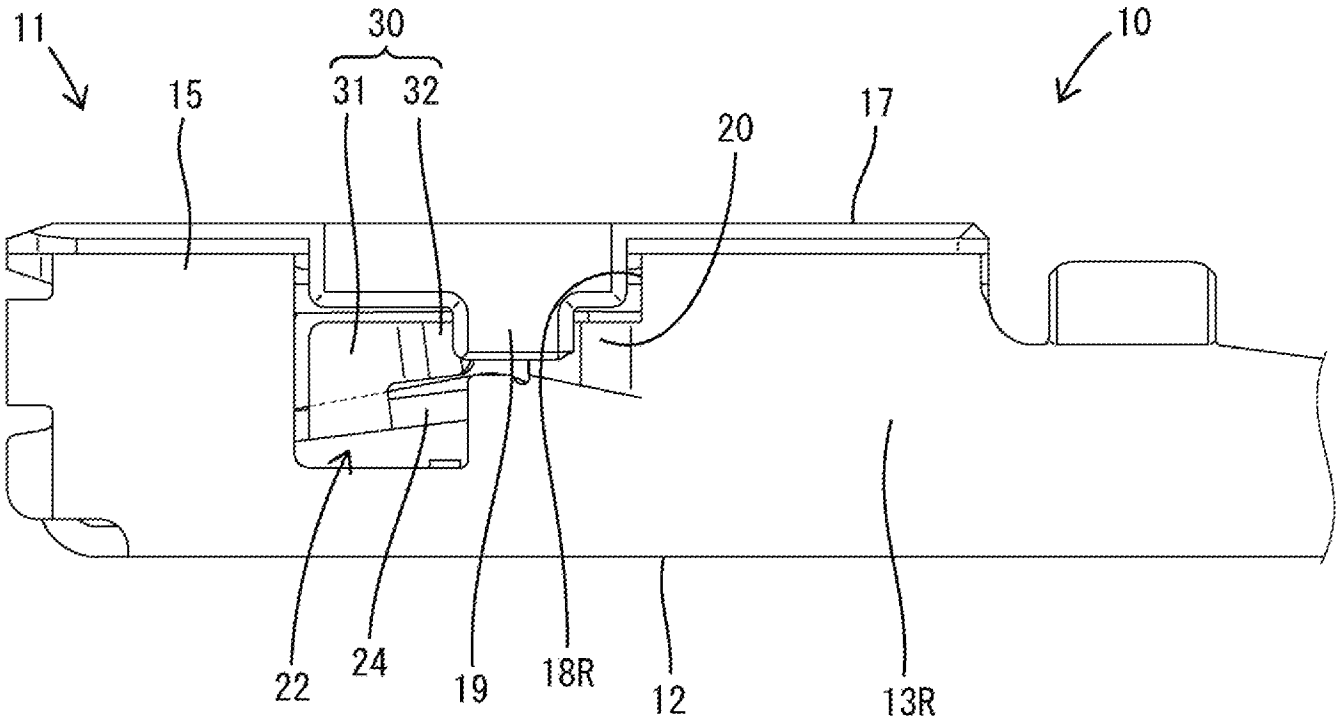
FIG. 4 is a right side view of the terminal fitting.
Figure 5:
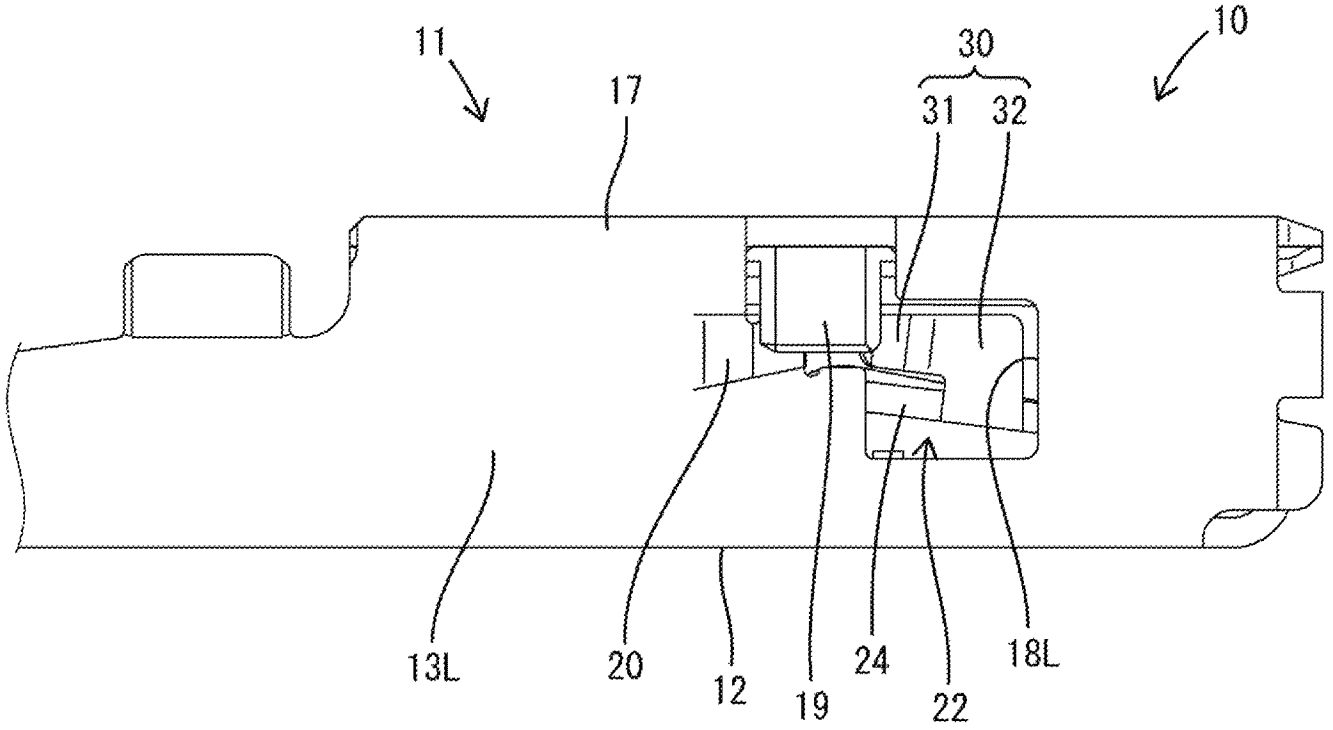
FIG. 5 is a left side view of the terminal fitting.

A specific embodiment of the invention is described with reference to FIGS. 1 to 10. In the following description, a left side in FIGS. 1, 3, 4, 6, and 7 to 10 is defined as a front concerning a front-rear direction. Upper and lower sides shown in FIGS. 1, 2, 4 to 6, 9 and 10 are defined as upper and lower sides concerning a vertical direction. Left and right sides shown in FIG. 2 are defined as left and right sides concerning a lateral direction.

A terminal fitting 10 of this embodiment is formed into a shape long and narrow in the front-rear direction by applying bending and the like to a metal plate material stamped into a predetermined shape. A front end part of the terminal fitting 10 defines a rectangular tubular body 11 having open front and rear ends. A tab 41 of a mating terminal 40 is inserted into the body 11 from the front. The tab 41 is a flat plate that is long and narrow in the front-rear direction and has a plate thickness direction aligned with the vertical direction. Note that a crimping portion in the form of an open barrel to be crimped to a wire (not shown) is connected behind the body 11, but the crimping portion is not shown in this embodiment.

The body 11 includes a flat base plate 12 that is long and narrow in the front-rear direction. A right side plate 13R rises substantially at a right angle from a right side of the base plate 12 and a left side plate 13R rises substantially at a right angle from a left side of the base plate 12. Two bilaterally symmetrical guides 14 are formed on front ends of the right and left side plates 13R, 13L and are folded inward in a width direction to cantilever rearward. The guides 14 correct a lateral positional deviation of the tab 41 inserted into the body 11.

A receiving plate 15 extends from an upper end of the right side plate 13E and is substantially parallel to the base plate 12. An area of the receiving plate 15 excluding both front and rear end parts and both left and right end parts bulges down toward the base plate 12 to form a pressure receiving portion 16. The lower surface of the pressure receiving portion 16 is substantially parallel to the base plate 12. A ceiling plate 17 extends from an upper end of the left side plate 13L and is substantially parallel to the base plate 12. The ceiling plate 17 is in contact with the outer peripheral edge of the upper surface of the receiving plate 15.

An excessive deflection restricting portion 19 is formed on an extending left end part of the receiving plate 15. The excessive deflection restricting portion 19 is disposed in a left cut 18L of the left side plate 13L and is parallel to the left side plate 13L. A deflection suppressing portion 19 is formed on an extending right end of the ceiling plate 17. The deflection suppressing portion 19 is disposed in a right cut 18R of the right side plate 13R and is parallel to the right side plate 13R. The excessive deflection restricting portion 19 of the receiving plate 15 and the excessive deflection restricting portion 19 of the ceiling plate 17 are shaped and arranged substantially bilaterally symmetrically.

The right side plate 13R is formed with a deflection suppressing portion 20 cantilevered forward into the right cut 18R from the rear end edge of the right side plate 13R facing the right cut 18R. The left side plate 13L also is formed with a deflection suppressing portion 20 cantilevered forward into the left cut 18L) from the rear end of the left side plate 13L facing the left cut 18L. The right and left deflection suppressing portion 20 are shaped and arranged substantially bilaterally symmetrically.

Extending front ends of the left and right deflection suppressing portions 20 define butting portions 21 protruding inward in the width direction in a stepped manner. An interval in the width direction between the inner surfaces of the left and right butting portions 21 is set substantially equal to a width of the tab 41. The left and right deflection suppressing portions 20 are resiliently deformable in the width direction.

A resilient contact piece 22 is cantilevered rearward into the body 11. The resilient contact piece 22 includes a base end 23, a flat surface portion 24, a curved surface 25 and a reinforcing portion 26. The base end 23 is bent substantially arcuately from the front end of the base plate 12 of the body 11 toward an upper rear side. The flat surface 24 extends obliquely toward an upper rear side from the rear end of the base end 23. Both upper and lower surfaces of an area of the flat surface 24 excluding a bulge 27 to be described later are flat.

The curved surface 25 extends rearward from the rear extending edge of the flat surface 24. The curved surface 25 is curved substantially arcuately to bulge up when viewed laterally. The reinforcing portion 26 is cantilevered obliquely toward a lower rear side from the rear end edge of the curved surface 25. A rear end part of the reinforcing portion 26 is resiliently in contact with the upper surface of the base plate 12. The resilient contact piece 22 can pivot in the width direction with the base end 23 as a support while resiliently deforming the base end 23. A pivoting direction of this resilient contact piece 22 is a direction intersecting an inserting direction of the tab 41 into the body 11.

A formation area of the flat surface 24 in the front-rear direction is only a range before the front ends of the deflection suppressing portions 20. In a side view, the butting portions 21 of the deflection suppressing portions 20 are slightly above a rear end part of the curved surface 25. Further, in a plan view, the butting portions 21 of the deflection suppressing portions 20 are at positions inward of both left and right side edges of the curved surface 25 (positions overlapping with the curved surface 25). In a plan view, the butting portion 21 of the deflection suppressing portion 20 is facing the inner surface of a rear end part of the excessive deflection restricting portion 19 in the width direction while being spaced apart.

The bulge 27 is formed in a widthwise central part of the upper surface of the resilient contact piece 22. The bulge 27 projects up toward the pressure receiving portion 16 of the receiving plate 15 over a rear end part of the flat surface 24 and the rear end part of the curved surface 25. In a side view, a top of the bulge 27 serves as a contact point 28 to be brought into point contact with the lower surface of the tab 41. The contact point 28 is the highest position on the upper surface of the resilient contact piece 22. Further, the contact point 28 is disposed in a formation area of the curved surface 25 in the front-rear direction.

The resilient contact piece 22 is formed integrally with two bilaterally symmetrical holding portions 30. The holding portions 30 include plate-like rising portions 31 extending up toward an insertion space for the tab 41 substantially at a right angle from both left and right sides of the flat surface 24 and contact portions 32 are cantilevered rearward from the rear ends of the rising portions 31. In a plan view, the contact portions 32 protrude in toward the insertion space for the tab 41 of the rising portions 31 in the width direction, and are disposed inwardly of both left and right side edges of the resilient contact piece 22 (rear end part of the flat surface 24 and front end part of the curved surface 25) in the width direction.

The holding portion 30 is resiliently deformable in the width direction. Further, a most inwardly protruding part of the inner surface of the contact portion 32 defines a ridge-like touching portion 33 extending along the vertical resiliently deforming direction of the resilient contact piece 22 in the process of inserting the tab 41. In a free state where the holding portions 30 are not resiliently deformed, a minimum interval in the width direction between the left and right touching portions 33 is equal to or smaller than the width of the tab 41. The touching portions 33 are disposed before the contact point 28. Further, an extending end part of the contact portion 32 is facing the inner surface of a front end part of the excessive deflection restricting portion 19 in the width direction while being spaced apart.

Next, functions of this embodiment are described. When the tab 41 is inserted into the body 11, the inserted end of the tab 41 contacts a rear end part of the upper surface of the flat surface 24 or a front end part of the bulge 27. Thereafter, as the tab 41 is inserted, the resilient contact piece 22 is pressed by the tab 41 to deform resiliently down. As the tab 41 is inserted, the amount of resilient deflection of the resilient contact piece 22 increases and insertion resistance also increases due to friction between the resilient contact piece 22 and the tab 41 and due to a resilient restoring force of the resilient contact piece 22.

As the tab 41 is inserted, both left and right side edges on the inserted end part of the tab 41 contact the touching portions 33 of the left and right holding portions 30, and the holding portions 30 deflect resiliently out in the width direction. Resilient restoring forces of the holding portions 30 that have been deflected generate friction and insertion resistance. Immediately after the tab 41 contacts the touching portions 33, the lower surface of the tab 41 contacts the contact point 28 of the resilient contact piece 22 and the upper surface of the tab 41 contacts the lower surface of the pressure receiving portion 16.

The amount of resilient deflection of the resilient contact piece 22 is maximized when the tab 41 reaches the contact point 28. When the tab 41 is inserted farther after the tab 41 contacts the contact point 28, the inserted end part of the tab 41 contacts the butting portions 21 of the deflection suppressing portions 20 to deflect the deflection suppressing portions 20 outwardly in the width direction. Resilient restoring forces of the deflection suppressing portions 20 that have been deflected generate friction and insertion resistance.

The properly inserted tab 41 is held in contact with the touching portions 33 of the holding portions 30 and in contact with the deflection suppressing portions 20. The properly inserted tab 41 is sandwiched resiliently by the two holding portions 30 from both sides in the width direction. The holding portions 30 are formed integrally with the resilient contact piece 22. Thus, the tab 41 is held close to the resilient contact piece 22 via the holding portions 30. Accordingly, the tab 41 and the resilient contact piece 22 are unlikely to be relatively displaced.

As described above, the terminal fitting 10 is designed to prevent fretting wear between the tab 41 and the resilient contact piece 22 and includes the body 11, the resilient contact piece 22 and the left and right holding portions 30. The body 11 is a rectangular tube and the tab 41 of the mating terminal 40 is inserted therein from the front. The resilient contact piece 22 is accommodated in the body 11 and resiliently sandwiches the tab 41 in a plate thickness direction of the tab 41 between the resilient contact piece 22 and the receiving plate 15 of the body 11.

Figure 6:
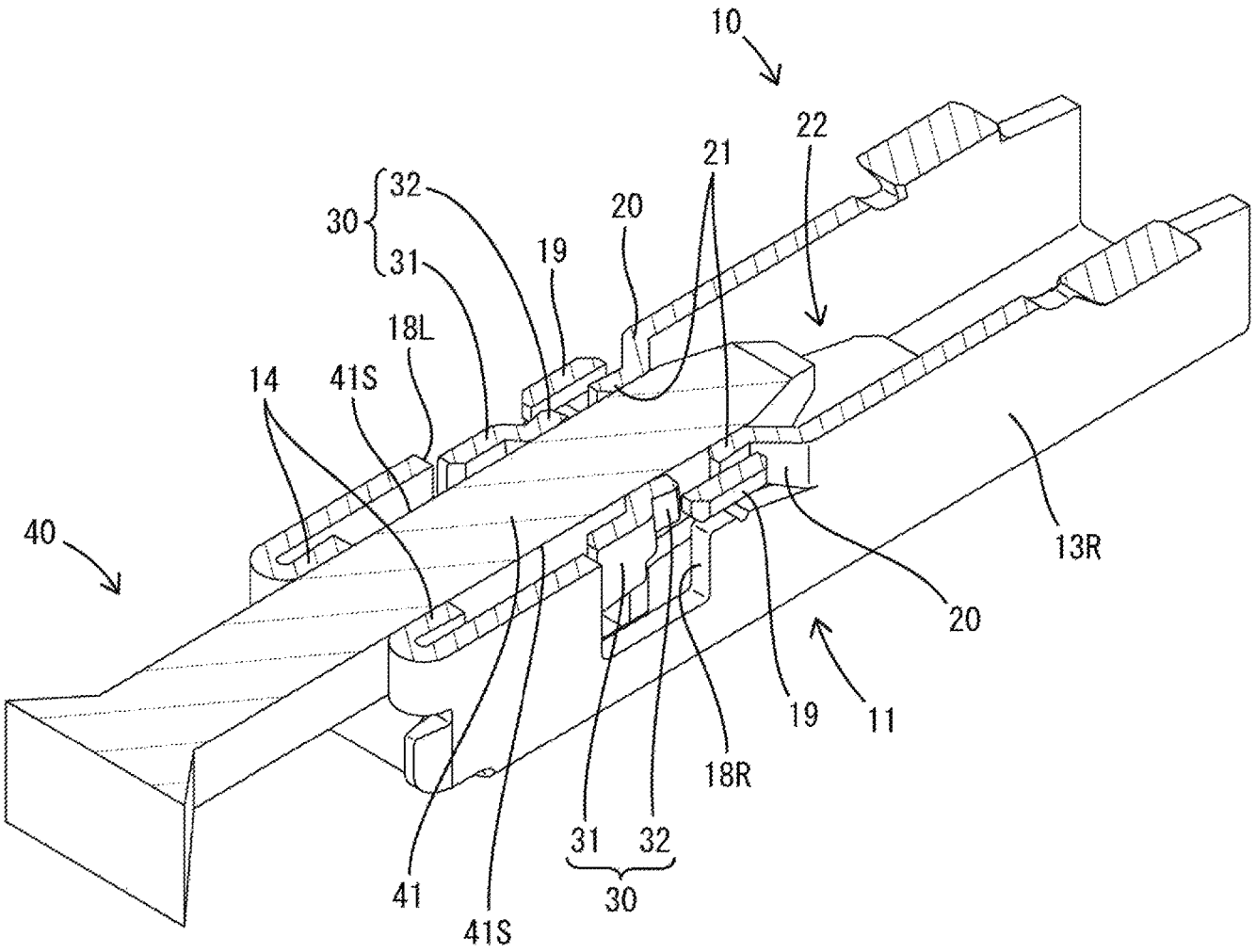
FIG. 6 is a perspective view with an inserted state of a tab in a body shown in a horizontal cross-section.
Figure 7:
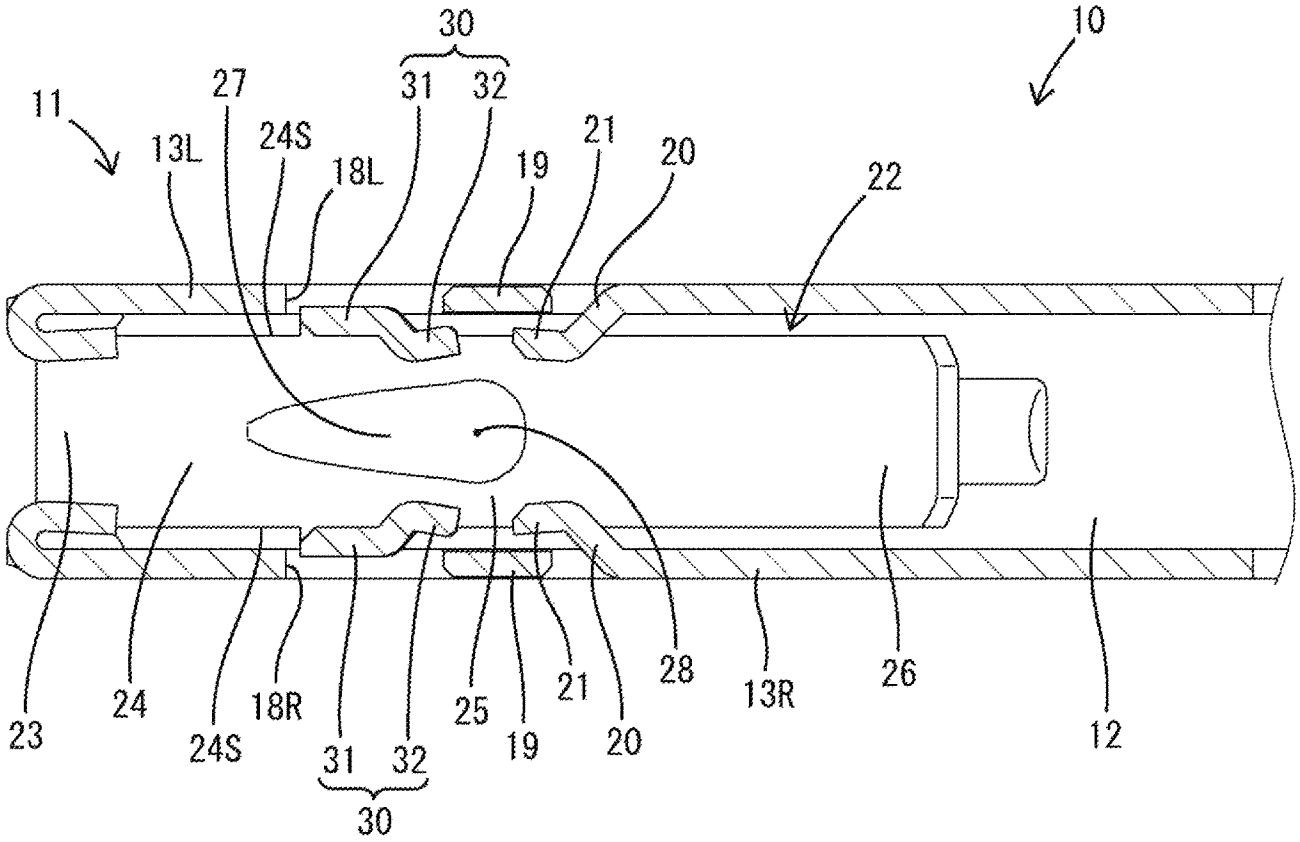
FIG. 7 is a section along X-X of FIG. 2.
Figure 8:
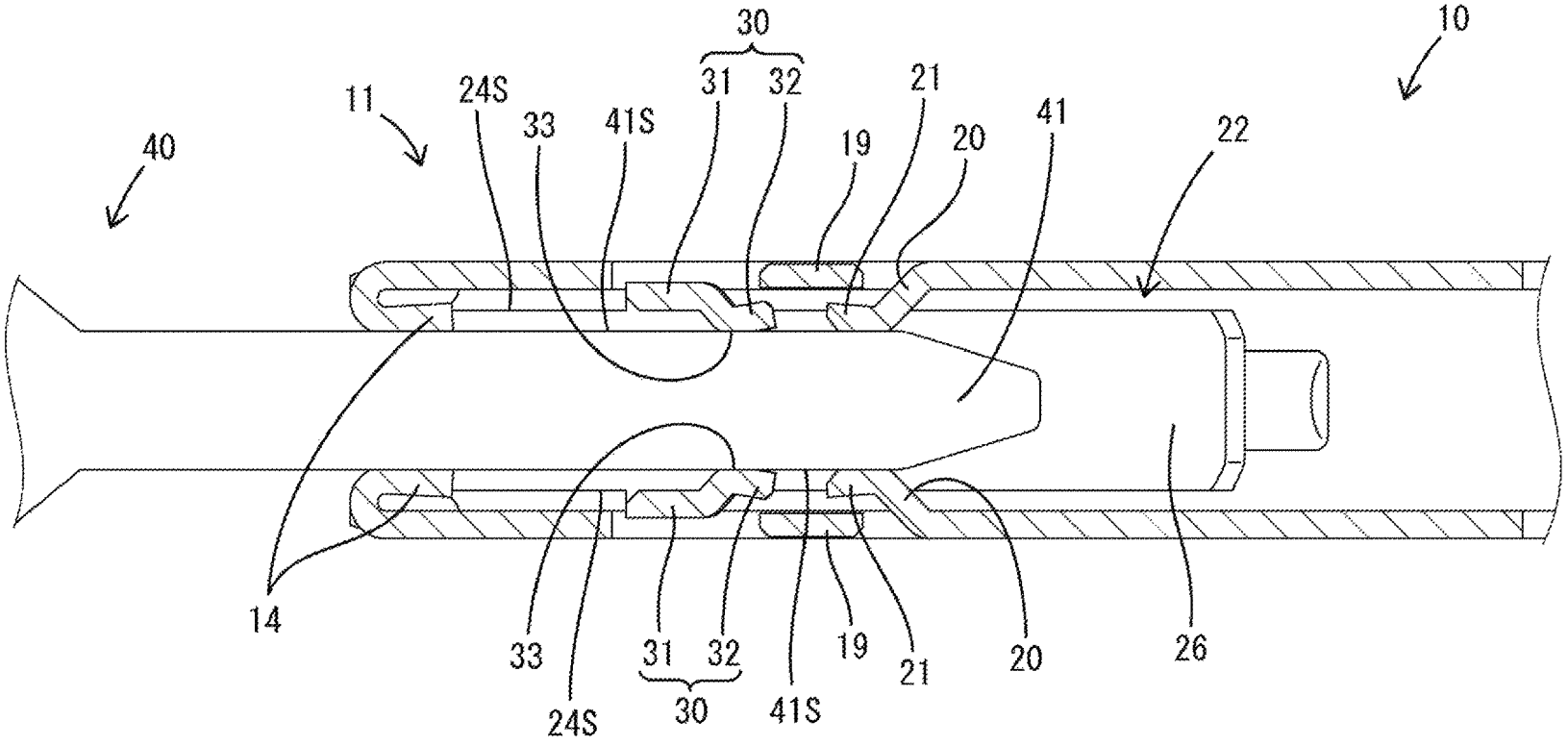
FIG. 8 is a section along X-X showing the inserted state of the tab in the body.
Figure 9:
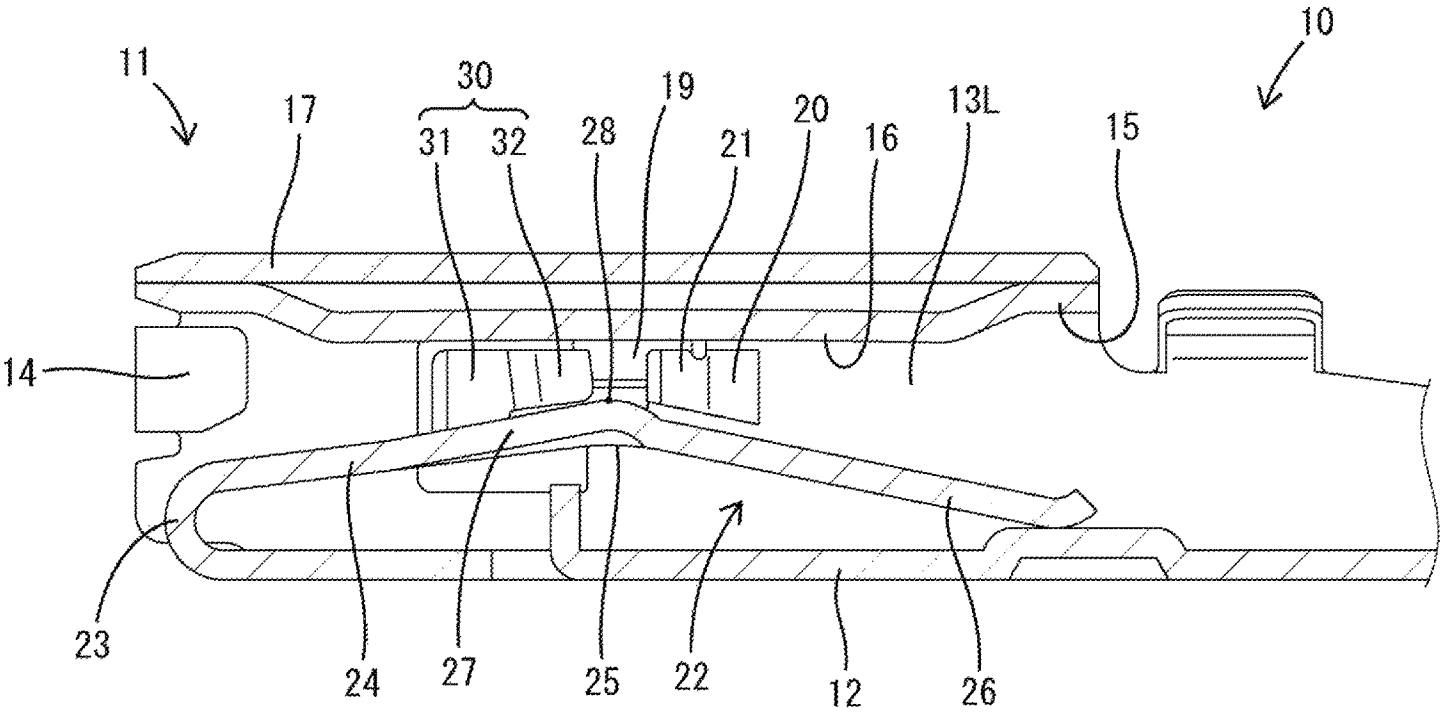
FIG. 9 is a section along Y-Y of FIG. 2.
Figure 10:
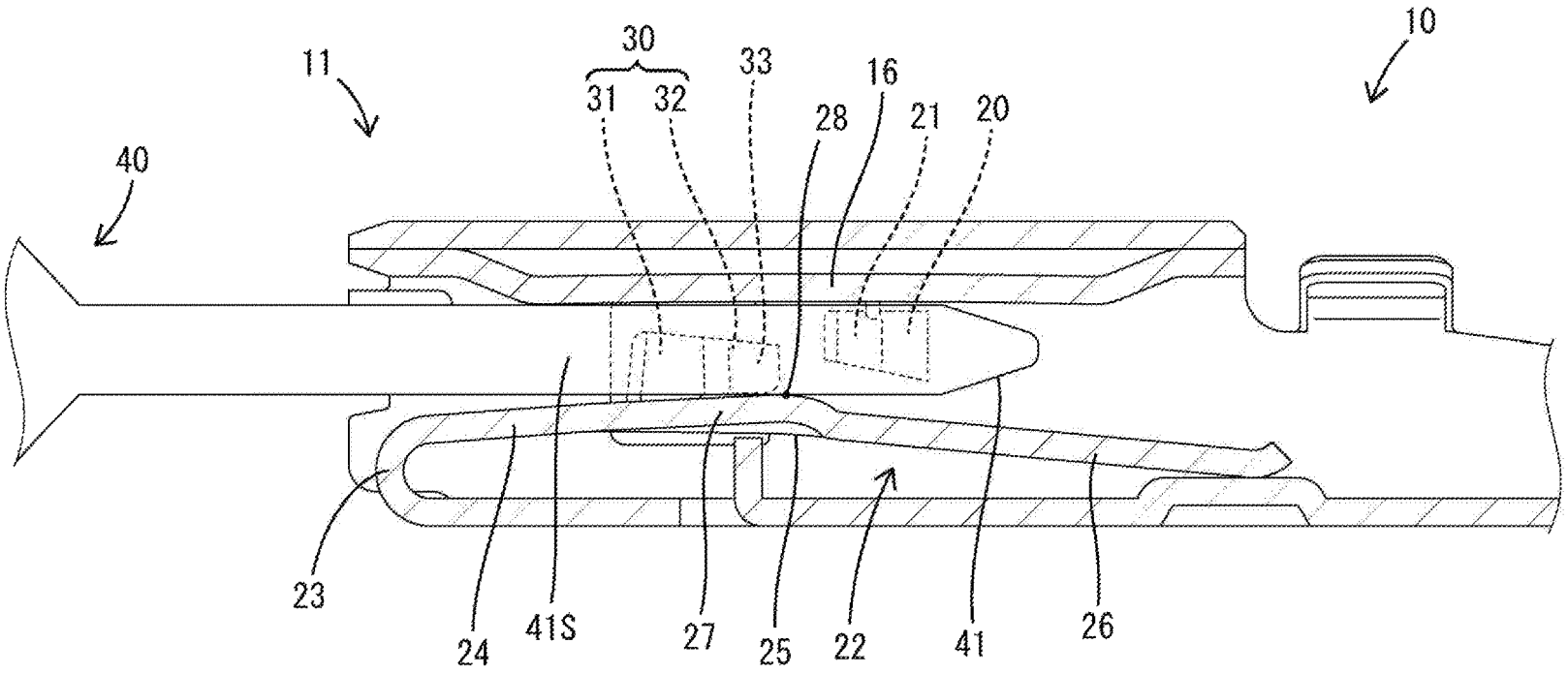
FIG. 10 is a section along Y-Y showing the inserted state of the tab in the body.

The left and right holding portions 30 are formed integrally to the resilient contact piece 22. With the tab 41 inserted in the body 11 and resiliently held in contact with the resilient contact piece 22, the two holding portions 30 bring the touching portions 33 thereof into contact with side edges 41S of the tab 41 to resiliently sandwich the tab 41 in the width direction as shown in FIG. 6. Thus, relative displacements of the tab 41 in the width direction with respect to the resilient contact piece 22 are restricted, and fretting wear due to relative displacements in the width direction does not occur between the resilient contact piece 22 and the tab 41.

Further, the holding portions 30 may be formed to be resiliently relatively displaceable in the width direction with respect to the resilient contact piece 22. Accordingly, in the process of inserting the tab 41 into the body 11, the holding portions 30 slide in contact with the side edges 41S of the tab 41 while being resiliently deformed. Therefore, insertion resistance due to friction between the tab 41 and the holding portions 30 is reduced.

The resilient contact piece 22 is a long and narrow plate and includes the base end 23, the flat surface 24, the curved surface 25 and the contact point 28. The base end 23 is connected to the front end of the base plate 12 of the body 11. The flat surface 24 extends obliquely from the base end 23 to the upper rear side along the inserting direction of the tab 41. The curved surface 25 is connected to the extending end of the flat surface 24. The contact point 28 is formed on the curved surface 25 and can contact the lower surface of the properly inserted tab 41.

The left and right holding portions 30 rise substantially at a right angle only from side parts 24S of the flat surface 24 of the resilient contact piece 22. The holding portions 30 are formed by being bent with respect to the resilient contact piece 22 and bending is performed at the side edges 24S of the flat surface 24. Thus, in forming the holding portions 30, the terminal fitting 10 of this embodiment is processed easily as compared to the case where the holding portions 30 are bent at the curved surface 25.

Further, the holding portion 30 includes the rising portion 31 connected to the flat surface 24 and the contact portion 32 extending from the rising portion 31 rearward toward the contact point 28 and capable of contacting the tab 41. The contact portion 32 of the holding portion 30 is configured to contact the tab 41 and is located near the contact point 28. Thus, the tab 41 can be held near the contact point 28, and relative displacements between the resilient contact piece 22 and the tab 41 at the contact point 28 can be suppressed.

The left and right side plates 13L, 13R of the body 11 are formed with the excessive deflection restricting portions 19 for contacting the outer surfaces of the contact portions 32 of the holding portions 30 and restricting the deformation of the resilient contact piece 22 beyond a resilient limit. Accordingly, even if the tab 41 and the resilient contact piece 22 are displaced in the width direction, the holding portion 30 contacts the excessive deflection restricting portion 19 to restrict any further positional deviations of the tab 41 and the resilient contact piece 22 while the amount of resilient deflection of the resilient contact piece 22 lies within the range of resilient limit. In this way, plastic deformation of the resilient contact piece 22 in the width direction can be prevented.

The left and right side plates 13L, 13R of the body 11 are formed with the deflection suppressing portions 20 capable of suppressing deformation of the resilient contact piece 22 in the width direction by having the side edges 41S of the tab 41 resiliently brought into contact therewith. According to this configuration, even if the tab 41 and the resilient contact piece 22 integrally displace in the width direction, positional deviations of the tab 41 and the resilient contact piece 22 are suppressed by resilient restoring forces of the deflection suppressing portions 20 while the amount of resilient deflection of the resilient contact piece 22 lies within the range of resilient limit. Therefore, excessive deformation of the resilient contact piece 22 in the width direction can be prevented.

Further, the excessive deflection restricting portions 19 can restrict the deformation of the deflection suppressing portions 20 beyond a resilient limit by contacting the outer surfaces of the butting portions 21 of the deflection suppressing portions 20. Thus, plastic deformation of the deflection suppressing portions 20 in the width direction can be prevented.

The excessive deflection restricting portions 19 are formed on the left and right side plates 13L, 13R and function both to restrict excessive resilient deflection of the resilient contact piece 22 and to restrict excessive resilient deflection of the deflection suppressing portions 20. Thus, the shapes of the left and right side plates 13L, 13R can be simplified in the terminal fitting 10 as compared to the case where the function of restricting excessive resilient deflection of the resilient contact piece 22 and the function of restricting excessive resilient deflection of the deflection suppressing portions 20 are performed by different parts.

The invention is not limited to the above described and illustrated embodiment. For example, the following embodiments are also included in the scope of the invention.

Although the holding portions are resiliently relatively displaceable in the width direction with respect to the resilient contact piece in the above embodiment, the holding portions may not be resiliently relatively displaced in the width direction with respect to the resilient contact piece.

Although the holding portions are bent at the flat surface portion in the above embodiment, the holding portions may be bent at the curved surface.

Although the contact portions configured to come into contact with the tab extended from the rising portions toward the contact point in the above embodiment, a contact portion configured to come into contact with the tab may rise from the resilient contact piece.

Although the excessive deflection restricting portions are formed on the side plates of the body in the above embodiment, the terminal fitting may include no excessive deflection restricting portion.

Although the deflection suppressing portions are formed on the side plates of the body in the above embodiment, the terminal fitting may include no deflection suppressing portion.

Although the excessive deflection restricting portions restrict plastic deformation of the deflection suppressing portions in the above embodiment, the excessive deflection restricting portions may not restrict excessive deflection of the deflection suppressing portions. In this case, a means for restricting excessive deflection of the deflection suppressing portions may be formed separately from the excessive deflection restricting portions.

Although the touching portion of the holding portion (contact portion) configured to touch the tab is disposed before the contact point in the above embodiment, the touching portion of the holding portion may be disposed at the same position as or behind the contact point in the front-rear direction.

Although the resilient contact piece is cantilevered rearward from the front end of the body in the above embodiment, the resilient contact piece may be cantilevered forward.

LIST OF REFERENCE SIGNS

10 . . . terminal fitting
11 . . . body
15 . . . receiving plate
19 . . . excessive deflection restricting portion
20 . . . deflection suppressing portion
22 . . . resilient contact piece
23 . . . base end
24 . . . flat surface
24S . . . side edge part of flat surface
25 . . . curved surface
28 . . . contact point
30 . . . holding portion
31 . . . rising portion
32 . . . contact point
40 . . . mating terminal
41 . . . tab
41S . . . side of tab

What is claimed is:

1. A terminal fitting assembly, comprising:

a body in the form of a rectangular tube, a tab of a mating terminal is inserted into the body;

a resilient contact piece accommodated in the body, the tab being resiliently sandwiched in a plate thickness direction thereof between a flat surface of the resilient contact piece and a receiving plate of the body; and a holding portion integrally formed to the resilient contact piece and rising, substantially at a right angle from a side part of the flat surface, the holding portion being capable of holding the tab with a relative displacement of the tab in a width direction with respect to the resilient contact piece restricted by coming into contact with a side edge part of the tab, the holding portion being resiliently displaceable in the width direction with respect to the resilient contact piece.

2. The terminal fitting assembly of claim 1, wherein:

the resilient contact piece includes a base end connected to the body, the flat surface extending from the base end along an inserting direction of the tab, a curved surface connected to an extending end of the flat surface and a contact point formed on the curved surface, the contact point being capable of contacting the properly inserted tab.

3. The terminal fitting assembly of claim 2, wherein the holding portion includes a rising portion connected to the flat surface and a contact portion extending from the rising portion toward the contact point, the contact portion being capable of coming into contact with the tab.

4. A terminal fitting assembly, comprising:

a body in the form of a rectangular tube, a tab of a mating terminal being inserted into the body;

a resilient contact piece accommodated in the body, the tab being resiliently sandwiched in a plate thickness direction thereof between the resilient contact piece and a receiving plate the body;

a holding portion integrally formed to the resilient contact piece, the holding portion being capable of holding the tab with a relative displacement of the tab in a width direction with respect to the resilient contact piece restricted by coming into contact with a side edge part of the tab; and an excessive deflection restricting portion formed on a side plate of the body, the excessive deflection restricting portion being configured to restricting deformation of the resilient contact piece beyond a resilient limit by having an outer surface of the holding portion brought into contact therewith.

5. The terminal fitting assembly of claim 4, wherein the holding portion is resiliently displaceable in the width direction with respect to the resilient contact piece.

6. The terminal fitting assembly of claim 4, further comprising a deflection suppressing portion formed on a side plate of the body, the deflection suppressing portion being capable of suppressing deformation of the resilient contact piece in the width direction by having a side of the tab resiliently brought into contact therewith, wherein:

the excessive deflection restricting portion is capable of restricting deformation of the deflection suppressing portion beyond a resilient limit by having an outer surface of the deflection suppressing portion brought into contact therewith.

7. The A terminal fitting assembly, comprising:

a body in the form of a rectangular tube, a tab of a mating terminal being inserted into the body;

a resilient contact piece accommodated in the body, the tab being resiliently sandwiched in a plate thickness direction thereof between the resilient contact piece and a receiving plate the body;

a holding portion integrally formed to the resilient contact piece, the holding portion being capable of holding the tab with a relative displacement of the tab in a width direction with respect to the resilient contact piece restricted by coming into contact with a side edge part of the tab; and a deflection suppressing portion formed on a side plate constituting the body, the deflection suppressing portion being capable of suppressing deformation of the resilient contact piece in the width direction by having a side edge part of the tab resiliently brought into contact therewith.

* * * * *